US006281891B1

(12) United States Patent
DaCosta et al.

(10) Patent No.: US 6,281,891 B1
(45) Date of Patent: Aug. 28, 2001

(54) DISPLAY WITH ARRAY AND MULTIPLEXER ON SUBSTRATE AND WITH ATTACHED DIGITAL-TO-ANALOG CONVERTER INTEGRATED CIRCUIT HAVING MANY OUTPUTS

(75) Inventors: Victor M. DaCosta, San Jose; Alan G. Lewis, Sunnyvale, both of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 08/458,539

(22) Filed: Jun. 2, 1995

(51) Int. Cl.[7] ..... G09G 5/00

(52) U.S. Cl. ..... 345/206; 345/98; 345/204

(58) Field of Search ..... 345/205, 206, 345/100, 98, 87, 55, 92, 204

(56) References Cited

U.S. PATENT DOCUMENTS

| | | | | |
|---|---|---|---|---|
| 4,766,426 | * | 8/1988 | Hatada | 345/206 |
| 4,859,998 | * | 8/1989 | Kawamura | 345/98 |
| 4,922,240 | * | 5/1990 | Duwaer | 345/205 |
| 5,162,786 | * | 11/1992 | Fukuda | 345/100 |
| 5,170,158 | * | 12/1992 | Shinya | 345/204 |
| 5,305,130 | | 4/1994 | Yamawaki | 359/88 |
| 5,341,233 | | 8/1994 | Tomoike et al. | 359/88 |
| 5,402,149 | | 3/1995 | Amagami et al. | 345/132 |
| 5,402,255 | | 3/1995 | Nakanishi et al. | 359/88 |
| 5,491,347 | | 2/1996 | Allen et al. | 257/59 |
| 5,510,807 | | 4/1996 | Lee et al. | 345/103 |
| 5,517,208 | | 5/1996 | Mori et al. | 345/87 |
| 5,532,718 | * | 7/1996 | Ishimaru | 345/205 |
| 5,557,534 | | 9/1996 | Wu | 364/491 |

FOREIGN PATENT DOCUMENTS

| | | | |
|---|---|---|---|
| 540163A2 | 5/1993 | (EP) | H03K/17/955 |
| 546780A1 | 6/1993 | (EP) | G09G/3/36 |
| 92 13902 | 5/1994 | (FR) . | |
| 9206597.8 | 11/1992 | (GB) . | |
| WO 94/16428 | 7/1994 | (WO) . | |

OTHER PUBLICATIONS

Matsueda, Y., Ashizawa, M., Aruga, S., Ohshima, H., and Morozumi, S., "Defect–Free Active–Matrix LCD with Redundant Poly–Si TFT Circuit," *SID 89 Digest*, vol. XX, 1989, pp. 238–241.

Lee, S.N., Stewart, R.G., Ipri, A., Jose, D., and Lipp, S., "FAM 13.5: A 5x9 Inch Polysilicon Gray–Scale Color Head Down Display Chip," 1990 IEEE International Solid–State Circuits Conference Digest of Technical Papers, 1990, pp. 220–221 and 301.

(List continued on next page.)

*Primary Examiner*—Kent Chang

(57) ABSTRACT

A product such as a display includes a first substrate on which array circuitry and multiplexer circuitry are formed and also includes one or more integrated circuit (IC) structures attached to the first substrate. The array circuitry includes N data lines, each driven by multiplexed signals, where N is greater than 32. The multiplexer circuitry provides the multiplexed signals in response to analog drive signals from P analog input leads and multiplexer control signals from Q control leads, where P is less than N but not less than 32 and where Q is less than N but not less than N/P. Each of R IC structures can includes a single crystal substrate, each with digital-to-analog converting (DAC) circuitry, where R is greater than zero. Each substrate has at least S analog output leads, where S is not less than 32. Together, the R IC structures have T analog output leads, where T is greater than P, and each of the P analog input leads is paired with and connected to one of the T analog output leads. The array circuitry and multiplexer circuitry can include polysilicon thin-film transistors (TFTs) on a glass substrate. The IC structure can be attached to the glass substrate using tape-automated bonding (TAB) or chip-on-glass (COG) techniques. This architecture makes it possible to use commercially available DAC ICs and significantly reduces the number of external chips required to drive the array as the number of pixels in the array increases.

12 Claims, 12 Drawing Sheets

OTHER PUBLICATIONS

Lewis, A.G., and Turner, W., "Dirver Circuits for AML-CDs," Conference Record of the 1994 International Display Research Conference and International Workshops on Active–Matrix LCDs & Display Materials, Monterey, California, Oct. 10–13, 1994, pp. 56–64.

Martin, R., Chuang, T., Steemers, H., Allen, R., Fulks, R., Stuber, S., Lee, D., Young, M., Ho, J., Nguyen, M., Meuli, W., Fiske, T., Bruce, R., Thompson, M., Tilton, M., and Silverstein, L.D., "P–70: A 6.3–Mpixel AMLCD," *SID 93 Digest*, 1993, pp. 704–707.

512x512 array sold before Jun. 2, 1994, described in Information Disclosure Statement dated Jan. 12, 1996.

Lewis, A., Da Costa, V., and Martin, R., "18.1: Poly–Si TFT Driver Circuits for a–Si TFT–AMLCDs," *SID 94 Digest*, vol. XXV, 1994, pp. 251–254.

Bond, J., and Levenson, M.D., "The US gears up to challenge Japan in flat panel displays," *Solid State Technology*, Dec. 1993, pp. 37, 38, and 40–43.

Morozumi, S., Oguchi, K., Misawa, T., Araki, R., and Ohshima, H., "18.4: 4.25–in. and 1.51–in. B/W and Full–Color LC Video Displays Addressed by Poly–Si TFTs," *SID 84 Digest*, vol. XV, 1984, pp. 316–319.

Lee, D.D., Da Costa, V.M., and Lewis, A.G., "TA 9.2: A VLSI Controller for Active–Matrix LCDs," 1994 IEEE International Solid–State Circuits Conference, 1994, pp. 156 and 157.

U.S. Patent Application No. 07/764, 292 entitled "Switched Capacitor Analog Circuits Using Polysilicon Thin Film Technology", filed on Sep. 23, 1991.

U.S. Patent Application No. 08/135,944 entitled "AM TFT LCD Universal Controller", filed on Oct. 13, 1993.

U.S. Patent Application No. 08/679,168 entitled "Universal Display That Presents All Image Types With High Image Fidelty", filed on Jul. 12, 1996.

U.S. Patent Application No. 08/559,862 entitled "Multiple Gate Polysilicon Structures With Continuously Doped Interchannel Regions", filed on Nov. 20, 1995.

U.S. Patent Application No. 08/560,724 entitled "Forming Array Having Multiple Channel Structures With Continuously Doped Interchannel Regions", filed on Nov. 20, 1995.

U.S. Patent Application No. 08/572,357 entitled "Array With Metal Scan Lines Controlling Semiconductor Gate Lines", filed on Dec. 14, 1995.

U.S. Patent Application No. 08/367,984 entitled "Circuitry With Gate Line Crossing Semiconductor Line At Two Or More Channels", filed on Jan. 3, 1995.

U.S. Patent Application No. 08/666,033 entitled "An Active Matrix Display With Integrated Drive Circuitry", filed on Jun. 19, 1996.

U.S. Patent Application No. 08/575,784 entitled "Array With Redundant Integrated Self–Testing Scan Drivers", filed on Dec. 22, 1995.

U.S. Patent Application No. 08/575,785 entitled "Array With Redundant Reparable Integrated Scan Drivers", filed on Dec. 22, 1995.

* cited by examiner

DISPLAY WITH ARRAY AND MULTIPLEXER ON SUBSTRATE AND WITH ATTACHED DIGITAL-TO-ANALOG CONVERTER INTEGRATED CIRCUIT HAVING MANY OUTPUTS

BACKGROUND OF THE INVENTION

The present invention relates to circuitry for driving data lines of an array formed on a substrate.

Matsueda, Y., Ashizawa, M., Aruga, S., Ohshima, H., and Morozumi, S., "Defect-Free Active-Matrix LCD with Redundant Poly-Si TFT Circuit," *SID* 89 *Digest*, Vol. XX, 1989, pp. 238–241, describe a liquid crystal display (LCD) in which an active matrix includes scanning lines and data lines formed on a substrate. As shown in FIG. 1, Y-drivers for the scan lines are formed on the same substrate, along two opposite sides of the active matrix. X-drivers for the data lines are also formed on the same substrate, along the other two sides of the active matrix. As described at page 238 in relation to FIG. 1, the X-drivers can include two shift registers, 16 video lines, and a 1280 TFT array controlled by the shift registers. Each video line can be divided into eight parallel lines to provide a data input frequency at which TFT circuits can operate. As shown in FIG. 1, each of the parallel lines is connected to a TFT of every eighth data line.

Lee, S. N., Stewart, R. G., Ipri, A., Jose, D., and Lipp, S., "FAM 13.5: A 5×9 Inch Polysilicon Gray-Scale Color Head Down Display Chip," 1990 *IEEE International Solid-State Circuits Conference Digest of Technical Papers,* 1990, pp. 220–221 and 301, describe a display in which scanning electronics can be integrated onto a glass plate along with pixel switching transistors. Both data-line and select-line driver circuits can be fabricated on a glass substrate along with polysilicon thin-film transistors. As shown and described in relation to FIG. 2, fully-redundant data scanners are at the top of array and select scanners are on left and right. As shown and described in relation to FIG. 3, gray-scale data scanners partitioned into registers driven from a bus have 25 leads connected to the inputs of four 20-stage shift registers that are driven by four external clocks separated by 90 degrees. A chop ramp scanning technique can handle the 32 gray levels color display requirement, with each data line driven by a transmission gate controlled by the output of a 5-bit counter. As shown and described in relation to FIG. 4, a five-bit gray scale counter is associated with the data scanner circuitry. During a first line period, a 5-bit gray scale code for each pixel is loaded into the data shift registers. At the end of the line period, the data is transferred from the shift register latches to the counters. During a second line period, a master data bus is ramped by a low impedance driver from 0V to 5V, as shown in FIGS. 6*a* and 6*b*. The master data line ramp is always the same and does not contain any image information. The analog information presented to the data lines depends entirely on the contents of their counters. The counter clock increments all data line counters, and whenever each counter reaches a count of 11111, it sets the control-latch flip-flop to turn off the transmission gate. This chop ramp scanning circuit can achieve accurate, uniform 32 step digital-to-analog conversion, and integration of the scanning circuitry can reduce the number of input leads. The data line driving circuitry includes only one analog input line, referred to as a ramp line. The ramp line provides a ramp signal to a channel lead of every transfer gate TFT. For each data line's TFT, a counter is connected between the shift register and the TFTs gate to ensure that each data line receives only its signal. FIG. 8 shows timing for the circuitry in FIG. 3, showing the RAMP line as an analog signal. FIG. 9 shows a chop ramp technique for gray scale conversion.

Lewis, EP-A 0 540 163, describes switched capacitor analog circuits constructed from polysilicon (poly-Si) TFTs and thin film capacitors (TFCs). The circuits can be fabricated on large area substrates and integrated with, for example, flat panel displays, pagewidth optical scan arrays, or pagewidth printheads. The analog switched capacitor circuits can be used to form data drivers, including sampling amplifiers and digital-to-analog converters (DACs) for AMLCDs. As shown and described in relation to FIGS. 5–9, switched capacitor amplifiers settle with cycle times well below 60 $\mu$s, the approximate line time available for a conventional TV resolution AMLCD; in addition, the amplifiers respond with good linearity and without clipping. As shown and described in relation to FIGS. 10–13B, all thin-film charge redistribution DACs can be constructed for AMLCD data driving or other applications. As shown and described in relation to FIGS. 14A and 14B, an array of video sampling amplifiers with polysilicon TFT components can be used to drive the data lines of an AMLCD. As shown and described in relation to FIGS. 15A and 15B, a display driver architecture can use DACs implemented entirely in TFTs and TFCs, with a multiplexer at the output of each DAC, allowing each DAC to drive several lines by switching the DAC output between the data lines.

SUMMARY OF THE INVENTION

The invention addresses problems that arise in providing data drive signals to an active matrix array of circuitry formed on a substrate.

A two-dimensional (2D) array, for example, can include two sets of conductive lines extending in perpendicular directions. Each line extending in one direction can provide signals to a column of the array; each line extending in another direction can provide signals to a row of the array.

Conventionally, each row-column position in a 2D array includes circuitry, sometimes called a "cell," that responds to signals on the lines for the cell's row and column combination. Through one set of parallel lines, illustratively called "data lines," each cell receives signals that determine its state. Through the other set of parallel lines, illustratively called "scan lines," each cell along a scan line receives a signal that enables the cell to receive signals from its data line.

In conventional arrays, each scan line provides a periodic scan signal that enables a component in each cell connected to the scan line to receive a signal from its data line during a brief time interval of each cycle. Therefore, tight synchronization of the scan signals with signals on the data lines is critical to successful array operation. Tight synchronization in turn requires that the driving signals to the data lines be provided with precise timing.

One way to obtain precisely timed data drive signals is to provide an external input lead for each data line. Groups of external input leads can then be connected by tape automated bonding (TAB) to circuitry that is external to the substrate. For example, the external circuitry can include, for each data line, a DAC implemented in single crystal circuitry. This approach requires a large number of TAB connections, however, and fails whenever one of the TAB connections fails mechanically. In addition, the large number of TAB connections precludes a small, high performance display such as a projection display.

The above-described article by Matsueda et al. exemplifies another approach that is used in conventional poly-Si TFT AMLCDs. In this approach, each of m analog input lines provides a data drive signal to every mth data line, and the data drive signals are sampled under control of a shift register that is integrated on the substrate. In this shift register sampling approach, each analog input line has an external input lead for receiving a data drive signal from one of m DACs on a board external to the substrate. The analog input lines and the shift register input leads are connected to a driver board through a flex connector.

The shift register sampling approach is problematic, however, because the time available for charging a data line is short, so that accurate voltage sampling is difficult, precluding accurate gray scale rendition. In addition, the clock rate required for the shift register can be very high. These problems become worse as the display pixel count increases.

The problems with shift register sampling can be alleviated by increasing m, the number of analog input lines. But one external DAC is normally required for each analog input line. Therefore, each additional analog input line increases the external system complexity and also increments the total chip count.

As a result of these problems, the shift register sampling approach is limited to low performance, low resolution applications such as portable televisions.

The above-described article by Lee et al. exemplifies yet another approach used in conventional poly-Si TFT AMLCDs. In this approach, non-linear ramp DACs are integrated on the glass substrate with the active matrix. As a result, digital input can be used, offering the potential of very good image uniformity.

Lewis, EP-A 0 540 163, described above, illustrates a similar approach that integrates non-linear switched capacitor DACs on the glass substrate with the active matrix. This approach also allows digital input.

The integrated DAC approaches share several drawbacks: First, the integrated drivers must be very complex, impacting yield and design times; second, poly-Si TFT performance is not as good as single crystal MOSFET performance, so that DACs are harder to design for poly-Si devices; third, each of the integrated DAC approaches requires many high voltage digital input lines, each with its own external amplifier; and finally, cell density is limited because DACs become longer as spacings between data lines decrease.

In addition, the ramp DAC approach uses a counter to generate a digital pulse whose width is controlled by the input data. This pulse activates a pass gate that transfers an external ramp voltage to the data line until the counter output goes low. The ramp voltage at this time then remains stored dynamically in the data line and can be transferred to the cells. The ramp DAC circuitry is thus largely digital, making the total device count high although the corresponding gate oxide area is moderate.

The switched capacitor DAC approach uses conventional charge sharing with non-linearly spaced reference voltages. The charge sharing scheme requires analog amplifiers and capacitors, both of which are much more expensive in terms of gate dielectric area than digital TFTs.

The invention is based on the discovery of a technique that avoids the problems with the conventional approaches described above. The technique provides array circuitry and multiplexer circuitry on a substrate. The technique also provides one or more integrated circuit (IC) structures attached to the substrate. Each IC structure includes a single crystal substrate with digital-to-analog circuitry that has at least 32 analog output leads and relatively few digital input channels, such as between 1 and 3 input channels. The single crystal substrate can be a commercially available DAC chip, receiving digital drive signals on a relatively small number of lines and providing analog drive signals on a relatively large number of lines. Currently available chips have, for example, three digital input channels, each a 6-bit or 8-bit channel, and 192, 201, or 240 analog output channels.

The technique avoids the need to integrate DACs on the same substrate as the array, while at the same time requiring only a small number of inexpensive, commercially available DAC chips. The technique thus provides an elegant but simple solution to the above-described problems with the conventional approaches.

The technique is applicable to array circuitry with N data lines, where N is greater than 32. Each data line has M units of cell circuitry, where M is greater than zero. Each data line also has a drive input lead in the multiplexer region. For each data line, the multiplexer has a drive output lead connected for providing multiplexed signals to the data line's drive input lead.

The multiplexer circuitry also has P analog input leads for receiving input analog drive signals from the single crystal substrates, where P is less than N but 32 or more. The multiplexer also has Q multiplexer control leads, where Q is not less than NIP. The multiplexer control leads can receive control signals either from circuitry external the substrate or from circuitry that is also integrated on the substrate.

Each of R integrated circuit structures can have a single crystal substrate, where R is greater than zero. DAC circuitry is formed at the surface of each single crystal substrate with each substrate having at least S analog output leads, where S is not less than 32. The DAC circuitry provides an analog drive signal on each analog output lead in response to a digital drive signal received by the DAC circuitry from digital input leads. The amplitude of the analog drive signal varies with a value indicated by the digital drive signal. Together, the integrated circuit structures have T analog output leads, where T is not less than P, so that each of the P analog input leads of the multiplexer circuitry is paired with and connected to one of the T analog output leads.

Each integrated circuit structure can be attached to the substrate so that its single crystal substrate is near the multiplexer circuitry. This can be accomplished, for example, using TAB connection or chip on glass (COG) mounting. As a result, batch processes can form the connections between the substrate and the multiplexer circuitry, so that all connections can be formed quickly.

Each integrated circuit structure can include a tape that is attached to the substrate and includes lines for connecting to the analog input leads. A single crystal substrate can be mounted on the tape. The R integrated circuit structures together can provide input analog drive signals to the P analog input leads through the P lines.

Or the integrated circuit structure can include a single crystal IC connected to pads on the substrate. The single crystal substrate can provide input analog drive signals to the analog input leads through the pads.

The array circuitry and multiplexer circuitry could be fabricated using poly-Si TFTs or other suitable TFTs formed on any appropriate substrate. For example, thin-film circuitry could be formed on an insulating substrate such as glass. The data lines could be aluminum.

The substrate with array circuitry and multiplexer circuitry can be part of a product that also includes signal input circuitry on another substrate, such as a printed circuit board. The signal input circuitry can have digital drive signal leads for providing digital drive signals to the digital input channels of the DAC circuitry. A tape can have lines connecting to the digital drive signal leads and lines connecting to the analog input leads of the multiplexer circuitry. A single crystal substrate mounted on the tape can have at least S analog output leads, as above, with DAC circuitry on the substrate receiving digital drive signals and providing analog drive signals in response.

The product can be a display with M scan lines and N data lines in the array. For the mth scan line and the nth data line, the array can include (m×n)th cell circuitry near the crossing region where the nth data line crosses the mth scan line. The (m×n)th cell circuitry can control light transmission or reflection in response to the signals on the mth scan line and the nth data line.

The technique described above is advantageous because it can provide simple multiplexer circuitry on the same substrate as an active matrix array without the necessity of a data scan shift register. Instead, the multiplexer circuitry can be controlled by external circuitry. If P is great enough to allow a settling time of approximately one microsecond, the external circuitry can be implemented with a small number of conventional fast, single crystal DAC chips intended for use with a-Si TFT AMLCDs, reducing external system complexity and cost.

The multiplexer can be connected to the external circuitry through a small number of TAB, COG, or flex cable connections. The small number of connections reduces the risk of mechanical failure.

The technique is also advantageous because the multiplexer can be implemented with poly-Si TFTs or any other TFT technology that meets modest performance requirements and that can also be used to implement the TFTs in the active matrix circuitry. Poly-Si TFT AMLCDs are advantageous in comparison with a-Si TFT AMLCDs because of more accurate pixel charging and higher aperture ratios. With the conventional single crystal DAC chips described above, the TFTs can be smaller because a longer time is available for charging so that a lower ON resistance is acceptable. The DAC chips can be driven with 5 volt digital inputs.

Because each data line is driven by a small amount of circuitry, i.e. one TFT, the data lines can be very dense, allowing a very dense array.

The following description, the drawings, and the claims further set forth these and other aspects, objects, features, and advantages of the invention.

DETAILED DESCRIPTION

A. Conceptual Framework

Figure 1:
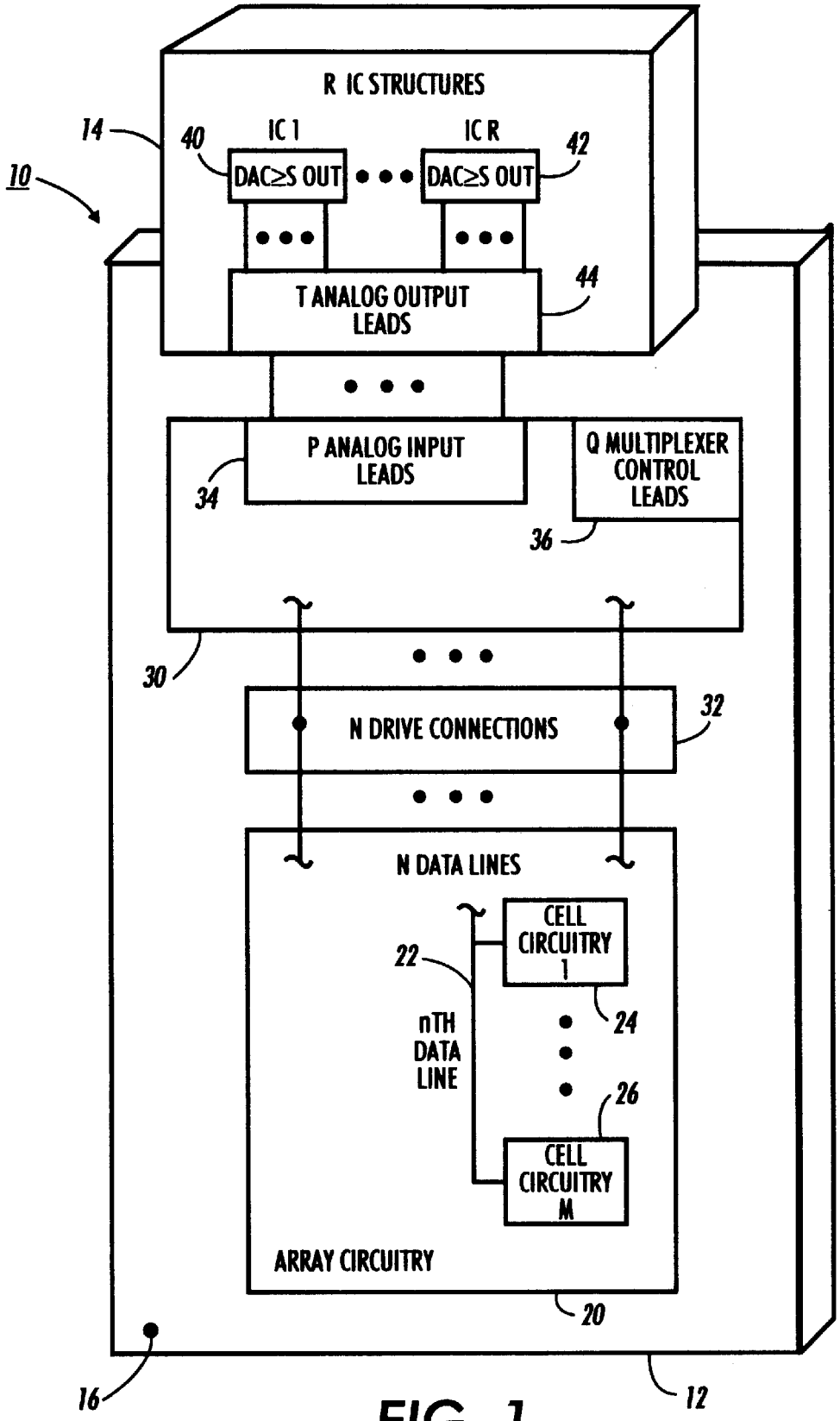
FIG. 1 is a schematic view of a product that includes array circuitry and multiplexer circuitry on a substrate with an attached integrated circuit structure that performs digital-to-analog conversion.

The following conceptual framework is helpful in understanding the broad scope of the invention, and the terms defined below have the indicated meanings throughout this application, including the claims.

"Circuitry" or a "circuit" is any physical arrangement of matter that can respond to a first signal received at one location or time by providing a second signal at another location or time, where the timing or content of the second signal provides information about timing or content of the first signal. Circuitry "transfers" a first signal when it receives the first signal at a first location and, in response, provides the second signal at a second location.

Any two components are "connected" when there is a combination of circuitry that can transfer signals from one of the components to the other. For example, two components are "connected" by any combination of connections between them that permits transfer of signals from one of the components to the other. Two components are "electrically connected" when there is a combination of circuitry that can transfer electric signals from one to the other. Two components could be electrically connected even though they are not physically connected, such as through a capacitive coupling.

A "substrate" is a unit of material that has a surface at which circuitry can be formed or mounted. An "insulating substrate" is a substrate through which no electric current can flow.

A "single crystal substrate" or "chip" is a substrate that includes only one crystal of material.

An "electric circuit" is a circuit within which components are electrically connected. An "electric structure" is a physical structure that includes one or more electric circuits.

A "thin-film structure" is an electric structure that is formed at a surface of an insulating substrate. A thin-film structure could be formed, for example, by deposition and patterned etching of films on the insulating substrate's surface.

An "integrated circuit" is a circuit formed at a substrate's surface by batch processes such as deposition, lithography, etching, oxidation, diffusion, implantation, annealing, and so forth.

An "integrated circuit structure" is a structure that includes a substrate on a surface of which an integrated circuit has been formed.

An integrated circuit structure is "attached" to another substrate if there is a physical attachment between the integrated circuit structure and the other substrate. Examples of techniques for attaching an integrated circuit structure to another substrate include tape-automated-bonding (TAB) and direct mounting techniques such as chip-on-glass (COG).

An integrated circuit structure is attached to a substrate so that a component of the structure is "near" a component of circuitry on the substrate if the attachment is such that the distance between two components is within one or two orders of magnitude of their largest outside dimension.

A "lead" is a part of a component at which the component is electrically connected to other components. A "line" is a simple component that extends between and electrically connects two or more leads. A line is "connected between" the components or leads it electrically connects. A lead of a component is "connected" to a lead of another component when the two leads are electrically connected by a combination of leads and lines. In an integrated circuit, leads of two components may also be "connected" by being formed as a single lead that is part of both components.

Each of a group of leads of a first component of circuitry is "paired with and connected to" one of a group of leads of a second component if each lead of the first component is connected to one and only one lead of the second component and if no lead of the second component is connected to more than one lead of the first component.

The terms "array" and "cell" are related: An "array" is an article of manufacture that includes an arrangement of "cells." For example, a "two-dimensional array" or "2D array" includes an arrangement of cells in two dimensions. A 2D array of circuitry may include rows and columns, with a line for each row and a line for each column. Lines in one direction may be "data lines" through which a cell receives or provides signals that determine or indicate its state. Lines in the other direction may be "scan lines" through which a cell receives a signal enabling it to receive signals from or provide signals to its data line.

In an array of circuitry, "cell circuitry" is circuitry connected to a cell's scan line and data line.

A "crossing region" is a region in which two lines cross, such as a scan line and a data line.

A "channel" is a part of a component through which electric current can flow. A channel is "conductive" when the channel is in a state in which current can flow through it.

A "channel lead" is a lead that connects to a channel. A channel may, for example, extend between two channel leads.

A "transistor" is a component that has a channel that extends between two channel leads, and that also has a third lead—referred to as a "gate lead" or simply "gate"—such that the channel can be switched between high impedance and low impedance by signals that change potential difference between the gate and one of the channel leads, referred to as the "source." The channel lead that is not the source is referred to as the "drain." Other components may have leads called gates, sources, and drains by analogy to transistors.

A "thin-film transistor" or "TFT" is a transistor that is part of a thin film structure.

A "capacitive element" is a component that stores a voltage level by storing charge. A capacitive element may include two conductive components, called "electrodes," separated by an insulating layer.

In a 2D array of circuitry, a cell's area may include a "cell electrode." A cell electrode may serve as one electrode of a capacitor whose other electrode is external to the array.

An "image" is a pattern of physical light.

An "image output device" is a device that can provide output defining an image.

A "display" is an image output device that provides information in a visible form.

A "liquid crystal cell" is an enclosure containing a liquid crystal material.

A "liquid crystal display" or "LCD" is a display that includes a liquid crystal cell with a light transmission characteristic that can be controlled in parts of the cell by an array of light control units to cause presentation of an image.

An "active matrix liquid crystal display" or "AMLCD" is a liquid crystal display that includes a liquid crystal cell and an array of cell circuitry that can cause presentation of an image by the liquid crystal cell.

A component of circuitry performs "multiplexing" if the component receives N time varying input signals, where N is greater than one, and responds by providing a single time varying output signal that includes parts, each part from one of the input signals. Multiplexing can be described as connecting one and only one input at a time to the output. Conversely, a component performs "demultiplexing" if the component receives a single time varying input signal and responds by providing N time varying output signals with each output signal including parts of the input signal. Demultiplexing can be described as connecting the input to one and only one output at a time.

Circuitry that performs multiplexing or demultiplexing is referred to herein as "multiplexer circuitry" or a "MUX." A signal that results from multiplexing or demultiplexing is referred to herein as a "multiplexed signal."

An "analog signal" is an electric signal whose voltage magnitude provides time varying information across a substantially continuous range of values.

A "digital signal" is an electric signal whose voltage magnitude provides time varying information at discrete values, typically two discrete values referred to as "high" and "low," "ON" and "OFF," or "0" and "1."

A component of circuitry performs "digital-to-analog conversion" or "D/A conversion" if the component receives a digital input signal and responds by providing an analog output signal that contains time varying information from the digital input signal. For example, an analog output signal has "an amplitude that varies with a value indicated by" a digital input signal if the analog output signal varies between voltages, each of which has an amplitude proportional to a value indicated by the digital input signal.

Circuitry that performs D/A conversion is referred to herein as "digital-to-analog circuitry," "D/A converter," or "DAC circuitry." An integrated circuit that includes DAC circuitry is referred to herein as a "DAC IC."

B. General Features

Figure 2:
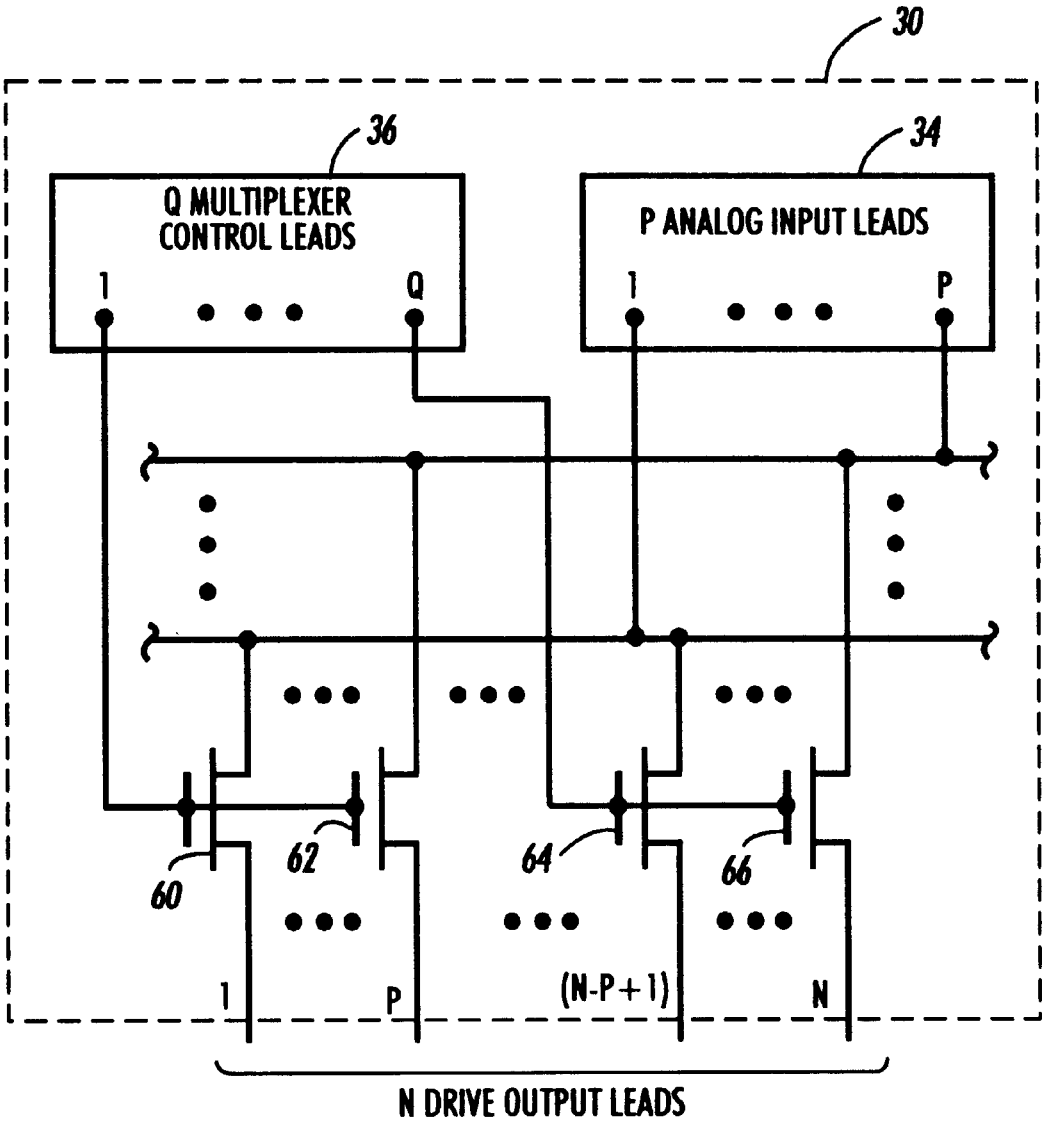
FIG. 2 is a schematic circuit diagram showing components of multiplexer circuitry that can be used in the product of claim 1.

FIGS. 1 and 2 show general features of the invention. FIG. 1 shows a substrate with array circuitry and multiplexer circuitry and with an attached integrated circuit structure. FIG. 2 shows an example of multiplexer circuitry that can be used in FIG. 1.

Product 10 in FIG. 1 includes substrate 12 and R integrated circuit (IC) structures 14, where R is one or more. Each of IC structures 14 is attached to substrate 12 and circuitry on surface 16 of substrate 12 is electrically connected to receive signals from circuitry in IC structures 14.

The circuitry formed on surface 16 of substrate 12 includes array circuitry 20, which has N data lines, where N is greater that 32. FIG. 1 illustratively shows nth data line 22, to which are connected M units of cell circuitry 24 through 26.

The circuitry formed on surface 16 of substrate 12 also includes multiplexer circuitry 30. The N data lines from array circuitry 20 extend into a multiplexer region of surface 16 where multiplexer circuitry 30 is formed. Each data line has a drive input lead connected to a drive output lead from multiplexer circuitry 30, producing N drive connections 32 between multiplexer circuitry 30 and array circuitry 20 as shown. Each drive output lead can provide multiplexed signals to the connected drive input lead.

Multiplexer circuitry 30 also includes P analog input leads 34, with P less than N but not less than 32, and Q multiplexer control leads 36, with Q less than N but not less than N/P. Analog input leads 34 receive input analog drive signals. Multiplexer control leads 36 receive multiplexer control signals. Multiplexer circuitry 30 responds to the input analog drive signals and the multiplexer control signals by providing multiplexed signals to drive connections 32.

IC structures 14 include R single crystal substrates 40 through 42. As shown, each of substrates 40 through 42 has DAC circuitry with at least S analog output leads, where S is not less than 32. The DAC circuitry provides, on each analog output lead, an analog drive signal with an amplitude that varies with a value indicated by a digital drive signal received from digital input leads. Together, substrates 40 through 42 therefore have T analog output leads 44, $T \geqq R \times S$. T is not less than P, and each of analog input leads 34 is paired with and connected to one of analog output leads 44 so that substrates 40 through 42 together provide the input analog drive signals to multiplexer circuitry 30.

As shown in FIG. 2, multiplexer circuitry 30 can include N transistors, of which transistors 60, 62, 64, and 66 are shown. If $N=P \times Q$, the N transistors can be grouped into Q groups of P transistors each, as shown, with transistors 60 through 62 being the first group and transistors 64 through 66 being the Qth group. The gates of all the transistors in each group can be connected to one of Q multiplexer control leads 36.

Within each group, each of P analog input leads 34 can be connected to a channel lead of one transistor, with transistors 60 and 64 illustratively connected to the first analog input lead and with transistors 62 and 66 illustratively connected to the Pth analog input lead. Each transistor's other channel lead is connected to one of the N drive output leads, with transistor 60 connected to the first drive output lead, transistor 62 to the Pth, transistor 64 to the (N−P+1)th, and transistor 66 to the Nth.

As a result of these connections, P transistors in each group concurrently provide signals from analog input leads 34 to a group of P drive output leads. Control signals are provided in sequence by Q multiplexer control leads 36 so that the groups are activated in sequence.

C. Implementation

The general features described above could be implemented in numerous ways in various products. The implementations described below include TAB and COG connections, and are suitable for AMLCDs. In general, the implementations described below make use of mounting techniques described in Lewis, A. G., and Turner, W., "Driver Circuits for AMLCDs," *Conference Record of the* 1994 *International Display Research Conference and International Workshops on Active-Matrix LCDs & Display Materials*, Monterey, Calif., Oct. 10–13, 1994, pp. 56–64, incorporated herein by reference.

C.1. TAB Implementation

Figure 3:
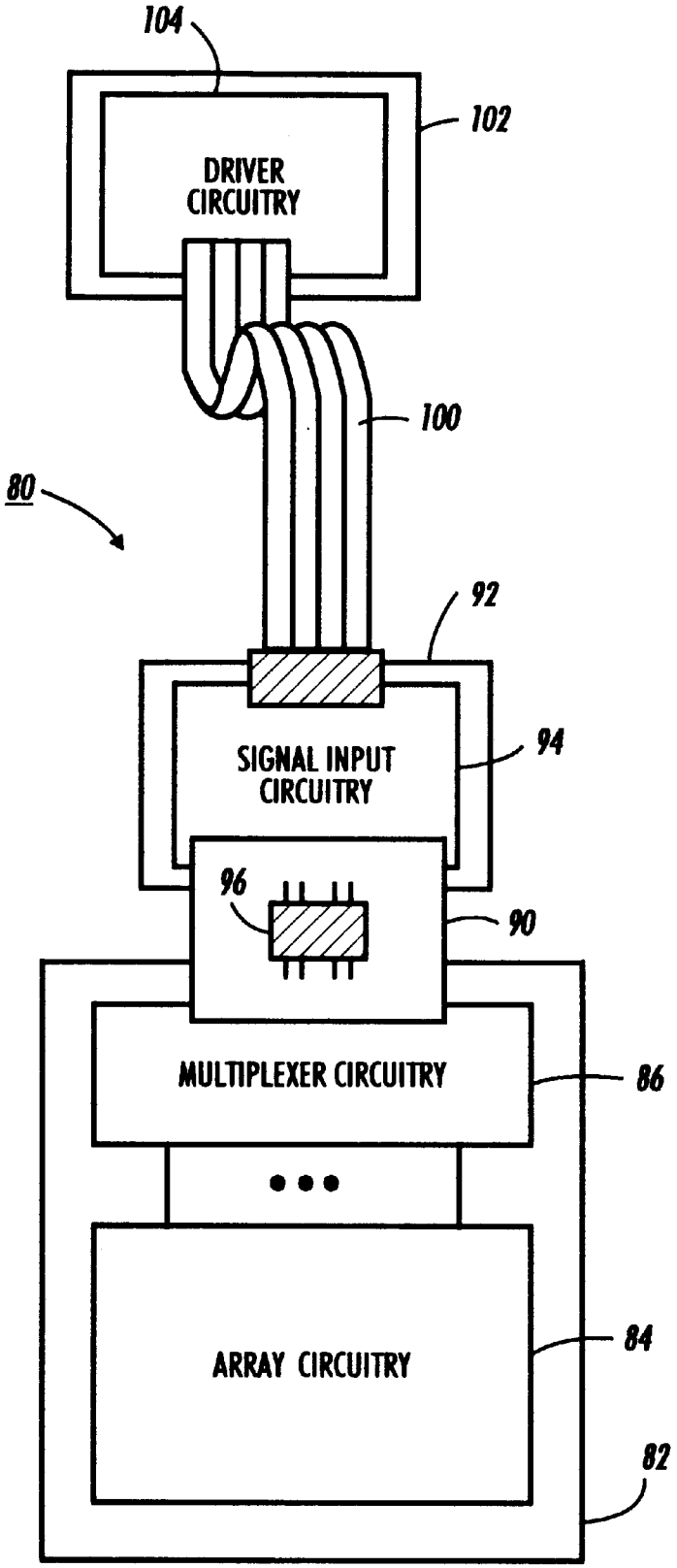
FIG. 3 is a schematic view of components of a product that includes an integrated circuit on a tape with a TAB connection to a substrate with array circuitry and multiplexer circuitry.
Figure 4:
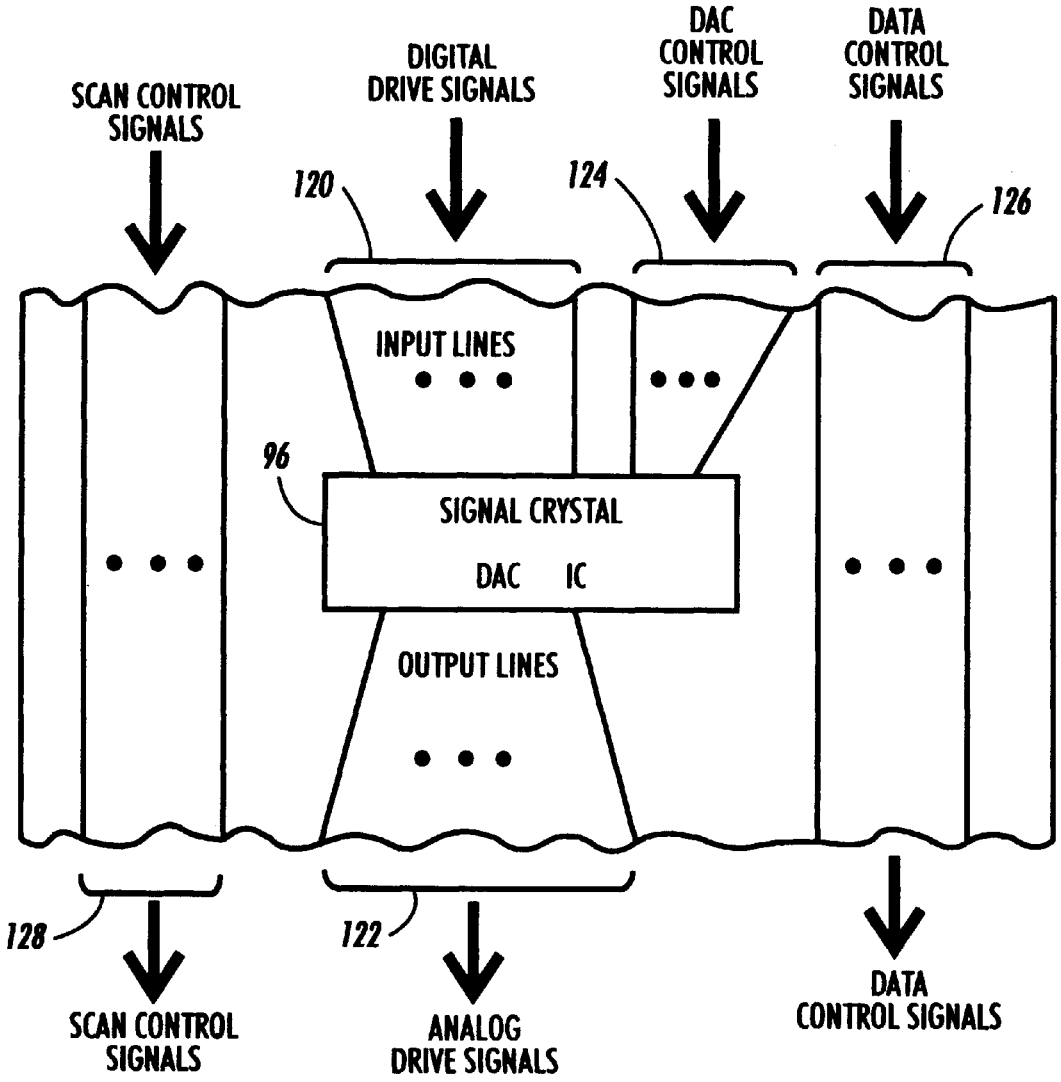
FIG. 4 is a schematic view of components on a TAB tape in FIG. 3.
Figure 5:
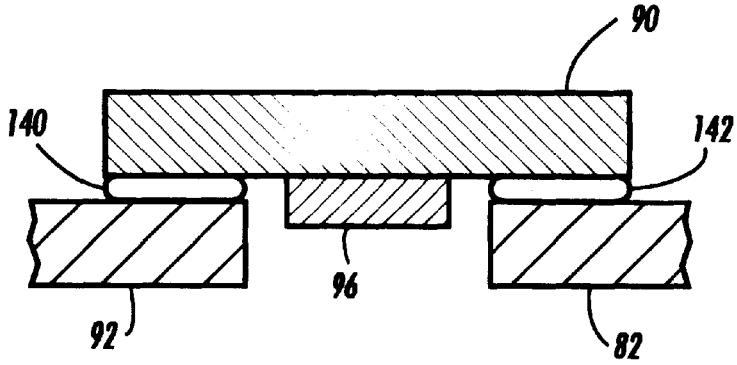
FIG. 5 is a schematic cross-sectional view showing attachments between a TAB tape and substrates in FIG. 3.
Figure 6:
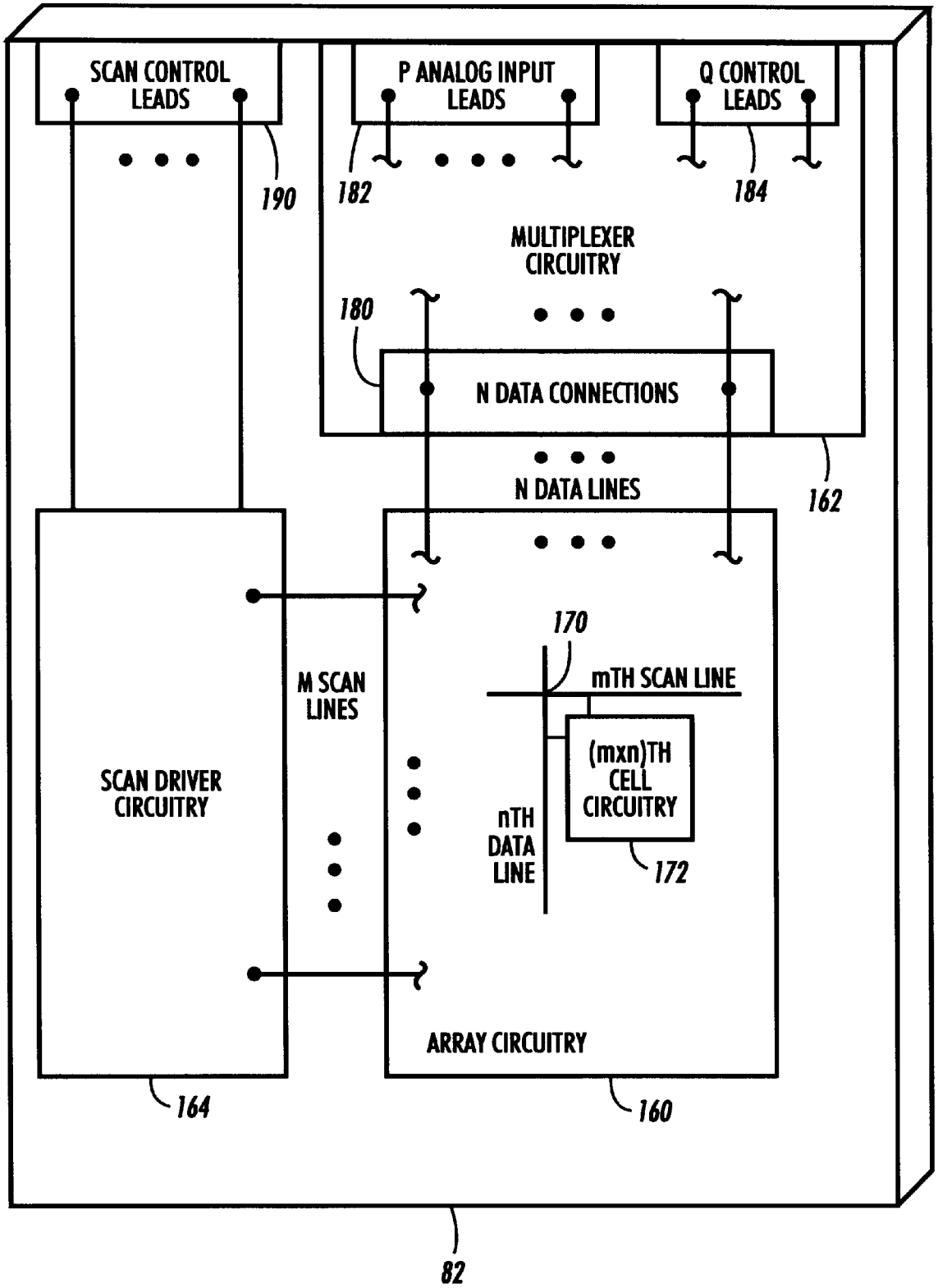
FIG. 6 is a schematic circuit diagram showing an example of circuitry on a substrate in FIG. 3.
Figure 7:
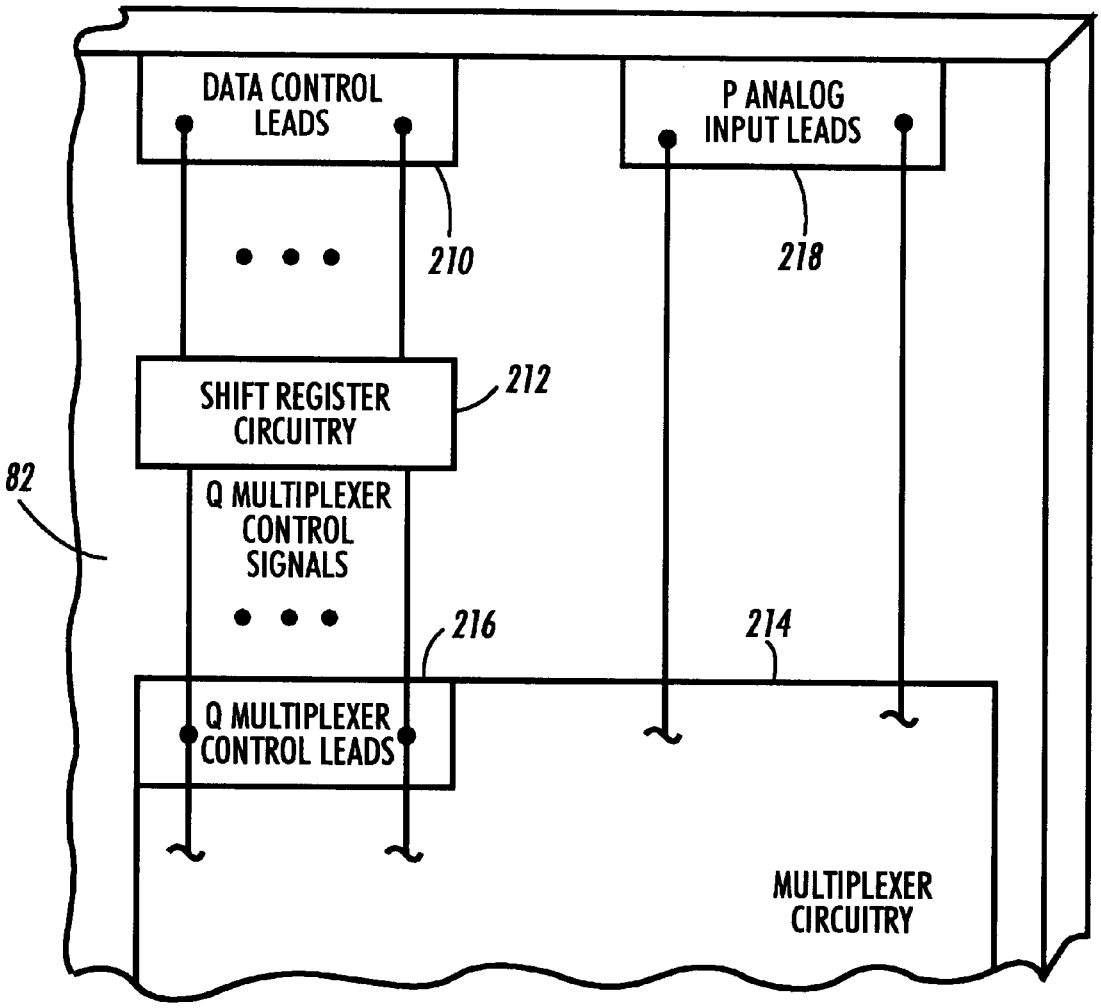
FIG. 7 is a schematic circuit diagram showing another example of circuitry on a substrate in FIG. 3.

FIGS. 3–7 show features of TAB implementations of the invention. FIG. 3 shows general components of a TAB implementation in which an integrated circuit structure includes a tape on which a single crystal digital-to-analog converter (DAC) integrated circuit (IC) is mounted. FIG. 4 shows a single crystal DAC IC mounted on a tape in the implementation of FIG. 3. FIG. 5 shows a cross section of the connections between the tape and leads on substrates in the implementation of FIG. 3. FIG. 6 shows one example of circuitry on a substrate in the implementation of FIG. 3. FIG. 7 shows another example of circuitry on a substrate in the implementation of FIG. 3.

Product 80 in FIG. 3 includes substrate 82 with array circuitry 84 and multiplexer circuitry 86 on its surface as in FIG. 1.

Product 80 also includes TAB tape 90 attached to substrate 82 and to printed circuit board 84. Printed circuit board 84 has signal input circuitry 94 on its surface and single crystal DAC IC 96 is mounted on TAB tape 90. IC 96 can be a commercially available DAC IC, such as a "Peanut" IC from Cirrus Logic Inc., Fremont, Calif., part number CL-FP6512 with three 6-bit digital input channels and 192 analog outputs or part number CL-FP6522 with three 6-bit digital input channels and 201 analog outputs. IC 96 could alternatively be a commercially available DAC IC from Vivid Inc., Santa Clara, Calif., or any other suitable DAC IC.

Product 80 also includes connector 100 attached to printed circuit board 92 and to driver board 102. Connector 100 could be a flex connector, a ribbon cable, or any other suitable multi-conductor connector.

Driver board 102 has driver circuitry 104 on its surface. Driver circuitry 104 can receive digital display control signals from a host machine and can respond by providing the digital drive signals to signal input circuitry 94 through connector 100. Driver board 102 can be a conventional video driver card with a number of video output lines appropriate for IC 96; in some implementations, driver circuitry 104 could simply include lines connecting signals from the host machine directly to connector 100.

TAB tape 90 connects multiplexer circuitry 86 to signal input circuitry 94, which can be conventional circuitry that includes driver circuitry as appropriate based on manufacturer specifications for IC 96 and that also includes control signal circuitry for multiplexer circuitry 86. In some implementations, signal input circuitry 94 can simply includes lines that provide electrical connections between connector 100 and tape 90; in others, signal input circuitry 94 can include a shift register or other appropriate circuitry. Signal input circuitry 94 can have digital drive signal leads (not shown) for providing digital drive signals to the DAC circuitry. Signal input circuitry 94 can also have data control leads (not shown) for providing control signals to data driver circuitry, as well as DAC control leads (not shown) for providing control signals to IC 96 and scan control leads (not shown) for providing scan control signals to scan drivers on substrate 82.

TAB tape 90 can be implemented with a sample tape from the manufacturer of IC 96. Sample tapes typically accommodate one IC per tape, and can be cut off at one of a number of lines to obtain leads with an appropriate pitch. Sample tapes typically have some dummy lines in addition to the input and output lines for the IC, but if a sample tape does not have enough dummy lines, a suitable connector such as a flex connector could be used to provide the additional lines.

FIG. 4 shows lines in TAB tape 90, assuming it is a sample with enough dummy lines or has been custom designed to have dummy lines as required. As shown in FIG. 4, TAB tape 90 can include input lines 120 for connecting to the digital drive signal leads and output lines 122 for connecting to analog input leads on substrate 82. Input lines 120 can transfer the digital drive signals from signal input circuitry 94 to IC 96. In response to the digital drive signals and to DAC control signals provided on lines 124 on TAB tape 90, IC 96 provides analog drive signals to output lines 122. Output lines 122 in turn transfer the analog drive signals to substrate 82.

FIG. 4 also shows how TAB tape 90 can include dummy lines 126 for connecting data control leads of signal input circuitry 94 to data control leads on substrate 82. Similarly, FIG. 4 shows how TAB tape 90 can include dummy lines 128 for connecting the scan control signal leads of signal input circuitry 94 to scan control leads on substrate 82.

Rather than providing dummy lines on TAB tape 90, a separate connector such as a flex connector could deliver multiplexer and scan control signals from driver circuitry 124 directly to leads on substrate 82.

FIG. 5 shows how TAB tape 90 can be attached to substrate 82 and to printed circuit board 92. An attachment to printed circuit board 92 can be formed by a soldered connection, schematically illustrated by solder layer 140 connecting a line on TAB tape 90 to a lead on printed circuit board 92. An attachment to substrate 82 can be formed by an adhesive, schematically illustrated by adhesive layer 142 connecting a line on TAB tape 90 to a lead on substrate 82. To prevent lateral conduction between lines and leads, adhesive layer 142 can be an anisotropic conductive adhesive such as a mixed thermal set/thermo plastic adhesive containing conductive spheres of 5–10 $\mu$m diameter. Conventional techniques such as alignment targets can be used to achieve alignment between pads on substrate 82 and lines on TAB tape 90.

FIG. 6 shows one example of circuitry on substrate 82 that could be used with TAB tape 90 as in FIGS. 3–5. The circuitry includes array circuitry 160, multiplexer circuitry 162, and scan driver circuitry 164.

Array circuitry 160 can be conventional circuitry with M scan lines and N data lines, with circuitry near crossing region 170 of the mth scan line and nth data line being shown in more detail. The scan lines and data lines can be perpendicular, so that array circuitry 160 defines a two-dimensional array. As shown, (m×n)th cell circuitry 172 is connected to receive signals from the mth scan line and the nth data line. Additional details about how array circuitry 160 could be implemented can be found in related U.S. patent application, Ser. No. 08/235,011, entitled "Thin-Film Structure with Dense Array of Binary Control Units for Presenting Images", Ser. No. 08/368,123 entitled "Array with Metal Scan Lines Controlling Semiconductor Gate Lines"; U.S. Pat. No. 5,557,534 entitled "Forming Array with Metal Scan Lines to Control Semiconductor Gate Lines"; and U.S. Pat. No. 5,608,557 entitled "Circuitry with Gate Line Crossing Semiconductor Line at Two or More Channels", all incorporated herein by reference.

The N data lines from array circuitry 160 extend into a multiplexer region where multiplexer circuitry 162 is formed. Each data line has a data input lead connected to a data output lead from multiplexer circuitry 162. FIG. 6 shows N data connections 180, in which each connection can include a data input lead and its connected data output lead. Each data output lead can provide multiplexed data drive signals to the connected data input lead.

Multiplexer circuitry 162 also includes P analog input leads 182, with P greater than one and less than N, and Q control leads 184, with Q less than N but not less than N/P. Each of leads 182 and 184 is at the edge of substrate 82 for connection to TAB tape 90. Control leads 184 receive control signals from circuitry external to substrate 82. The external circuitry can include conventional shift registers and buffers (not shown) on printed circuit board 92 that receive signals from driver circuitry 104 and, in response, provide Q control signals in parallel. Therefore, lines 126 in FIG. 4 can include Q lines for transferring Q control signals in parallel.

Analog input leads 182 receive input analog drive signals. Q control leads 184 receive multiplexer control signals. Multiplexer circuitry 162 responds to the input analog drive signals and the multiplexer control signals by providing the multiplexed data drive signals to data connections 180.

Multiplexer circuitry 162 can be implemented as shown in FIG. 2 or with other appropriate circuitry. The implementation in FIG. 2 is especially elegant: It allows a very high packing density because each data line has only one drive TFT; it is simple to implement and manufacture, especially because it can be implemented solely with NMOS devices, avoiding the additional implants and masking operations necessary to manufacture CMOS devices.

The M scan lines from array circuitry 160 extend into a scan driver region where scan driver circuitry 164 is formed. Each scan line has a scan input lead connected to a scan output lead from scan driver circuitry 164. Scan driver circuitry 164 provides scan signals in response to scan control signals received through scan control leads 190, also on the edge of substrate 82 for connection to TAB tape 90. Scan driver circuitry 164 can be conventional.

FIG. 7 shows another example of circuitry that could be integrated on substrate 82. If integration technology permits its implementation, the circuitry in FIG. 7 could be advantageous because it can reduce the number of data control lines 126 that are required on TAB tape 90.

Data control leads 210 in FIG. 7 include only those lines necessary to control shift register circuitry 212, which can be conventional circuitry implemented as appropriate for the integration technology employed to implement other circuitry on substrate 82, such as poly-Si TFT technology. For example, data control leads 210 could include VDD, VSS, Clock, Reset, and Enable lines, all of which could be provided through data control lines 126 on TAB tape 90 and through appropriate lines on printed circuit board 92 and in flex connector 100 from driver circuitry 104. Shift register circuitry 212 must provide output signals that can drive multiplexer control lines. For this purpose, shift register circuitry 212 could include an appropriate buffer, or a shift register with stages that include big TFTs.

In response to the data control signals, shift register circuitry 212 provides Q multiplexer control signals. As in FIG. 6, multiplexer circuitry 214 has Q multiplexer control leads 216 and also receives analog drive signals from P analog input leads 218. The remainder of the circuitry on substrate 82 can therefore be the same as in FIG. 6.

C.2. COG Implementation

Figure 8:
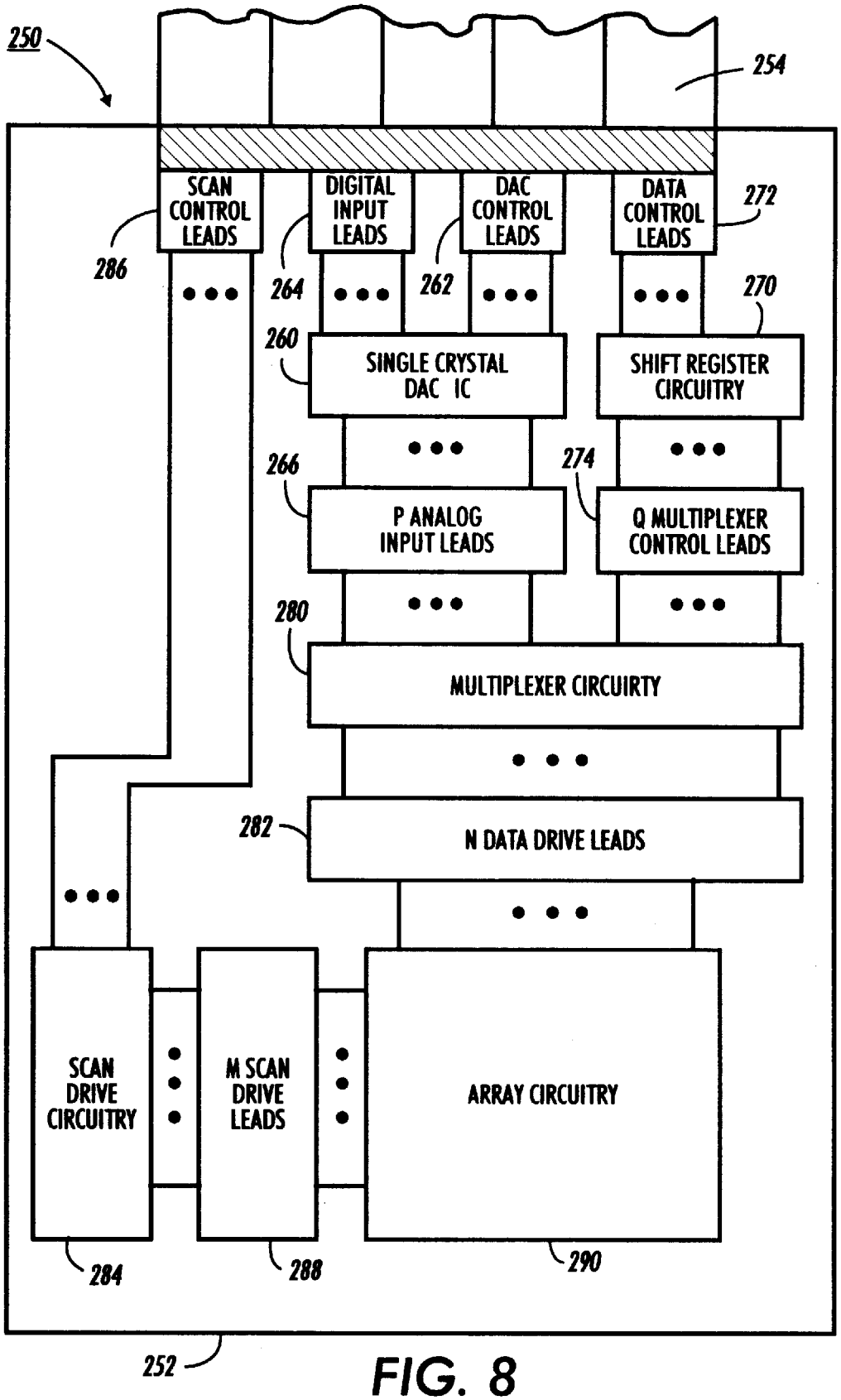
FIG. 8 is a schematic view showing of components of a product that includes an integrated circuit COG mounted on a substrate with array circuitry and multiplexer circuitry.
Figure 9:
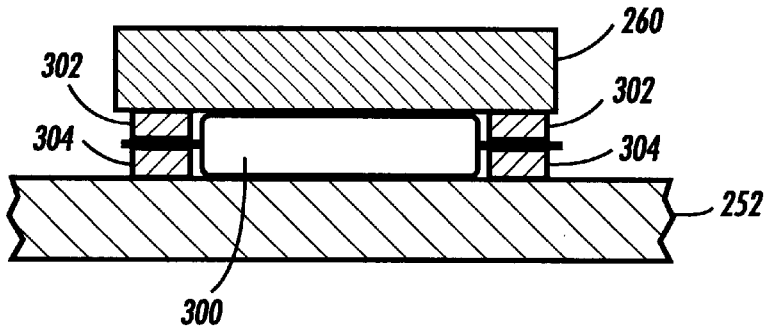
FIG. 9 is a schematic cross-sectional view showing attachments between a single crystal DAC IC and a substrate in FIG. 8.

FIGS. 8 and 9 show features of a COG implementations of the invention. FIG. 8 shows general components of a COG implementation in which a single crystal DAC IC is directly mounted on a substrate that includes array circuitry and multiplexer circuitry. FIG. 9 shows a cross section of the connections between the DAC IC and the substrate in the implementation of FIG. 8.

Product 250 in FIG. 8 includes substrate 252 to which connector 254, such as a flex connector, a ribbon cable, or other suitable connector, is connected using conventional gluing techniques. Connector 254 provides signals similar to those provided by driver circuitry 104 in FIG. 3.

Single crystal DAC IC 260, which can be implemented as in FIGS. 3 and 4, is mounted on substrate 252 using COG techniques, as described below. IC 260 receives DAC control signals through DAC control leads 262 and digital drive signals through digital input leads 264. In response, IC 260 provides P analog drive signals through analog input leads 266.

Shift register circuitry 270, which can be implemented as in FIG. 8, receives data control signals through data control leads 272. In response, shift register circuitry 270 provides Q multiplexer control signals through multiplexer control leads 274.

Multiplexer circuitry 280, which can be implemented as in FIG. 2, receives P analog drive signals from leads 266 and Q multiplexer control signals from leads 274. In response, multiplexer circuitry 280 provides N data drive signals through leads 282.

Scan driver circuitry 284, which can be conventional circuitry, receives scan control signals from scan control leads 286. Scan driver circuitry 284 responds by providing M scan drive signals through leads 288.

Array circuitry 290, which can be implemented as in FIG. 6, receives M scan drive signals from leads 288 and N data drive signals from leads 282. In response, array circuitry 290 presents an image.

FIG. 9 shows how IC 260 can be attached to substrate 252. A flip chip on glass (FCOG) attachment to substrate 252 can be formed by an adhesive, schematically illustrated by adhesive layer 300 connecting pads 302 on IC 260 to pads 304 on substrate 252. Pads 302 could be taller gold bumps and pads 304 shorter gold bumps, and adhesive layer 300 could include ultraviolet cured epoxy. Or pads 302 could be short gold bumps and pads 304 ITO, and adhesive layer 300 could be an anisotropic conductive adhesive that prevents lateral conduction as described above in relation to FIG. 5. Wirebonding COG techniques could also be used.

C.3. Results

The techniques described above have been successfully simulated. The simulation resembled the implementation shown in FIGS. 3–6, but differed from that implementation by attaching TAB tape 90 to an additional printed circuit board in place of substrate 52, and by then connecting the additional printed circuit board through a ribbon cable glued to substrate 52 to obtain an electrically equivalent circuit. The circuitry on substrate 52 included a 512 by 512 pixel array and required 64 analog input signals and eight scan control signals, which were provided through an additional flex connector.

In addition, the techniques described above have been compared with other available architectures, as shown in FIGS. 10–14. Each figure compares the architecture in FIGS. 3–6 ("Prop arch") with several alternatives, such as a wide multiplexer ("Wide MUX"), a ramp DAC architecture ("Ramp DAC"), and a switched capacitor DAC architecture ("SC DAC"). In addition, FIG. 14 also compares a 10V swing driver chip ("Prop arch (HV)") with the 5V swing driver chip used in Prop arch.

Figure 10:
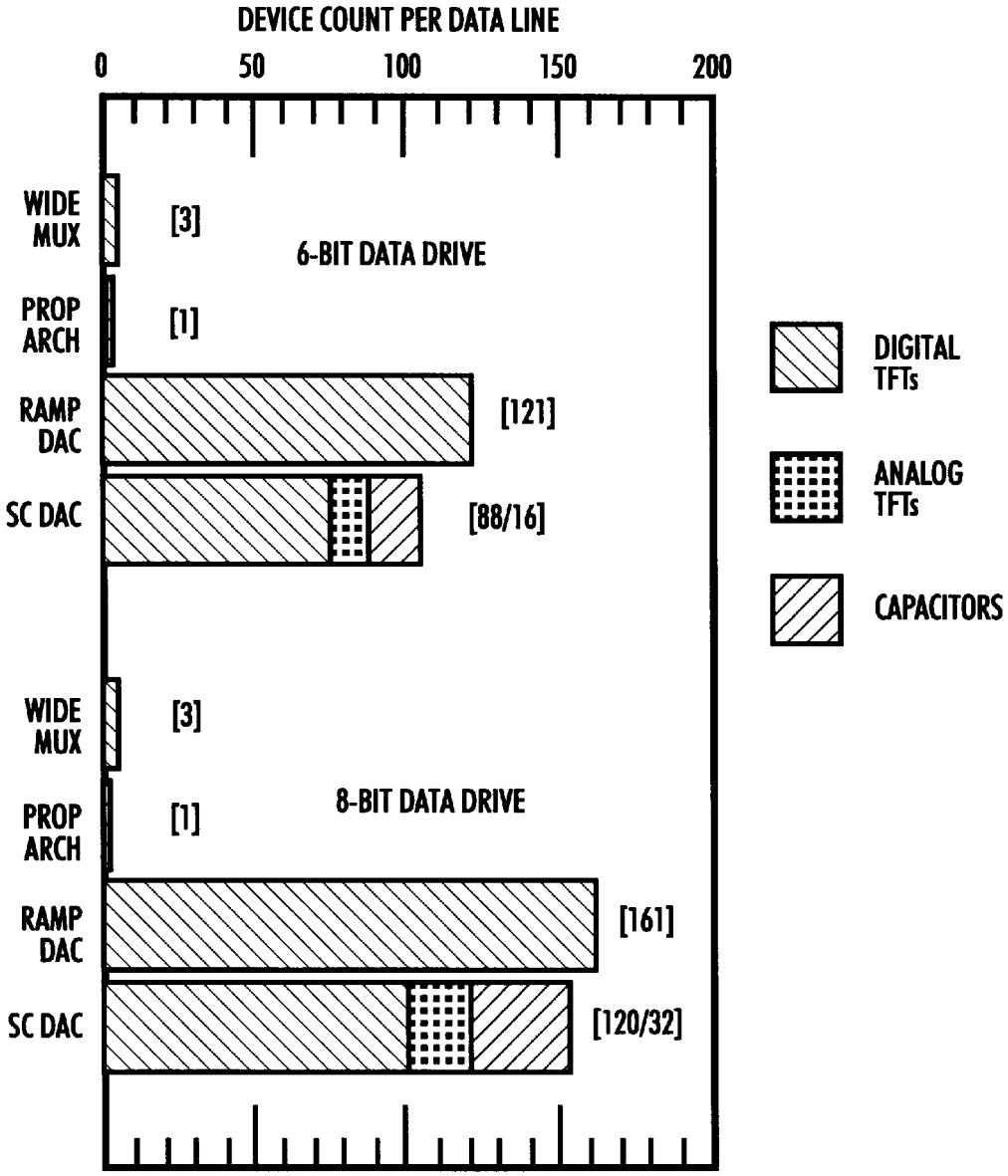
FIG. 10 is a bar graph comparing device counts for the implementation of FIGS. 3–6 with several other architectures.

FIG. 10 compares the data driver device counts for each data line for 6- and 8-bit precision drivers. The Ramp DAC and SC DAC architectures have high TFT counts. This comparison is misleading, however, unless the different areas occupied by different devices are considered: A TFT in an analog amplifier is typically large compared with a TFT in a digital circuit, and capacitors can be even larger.

Figure 11:
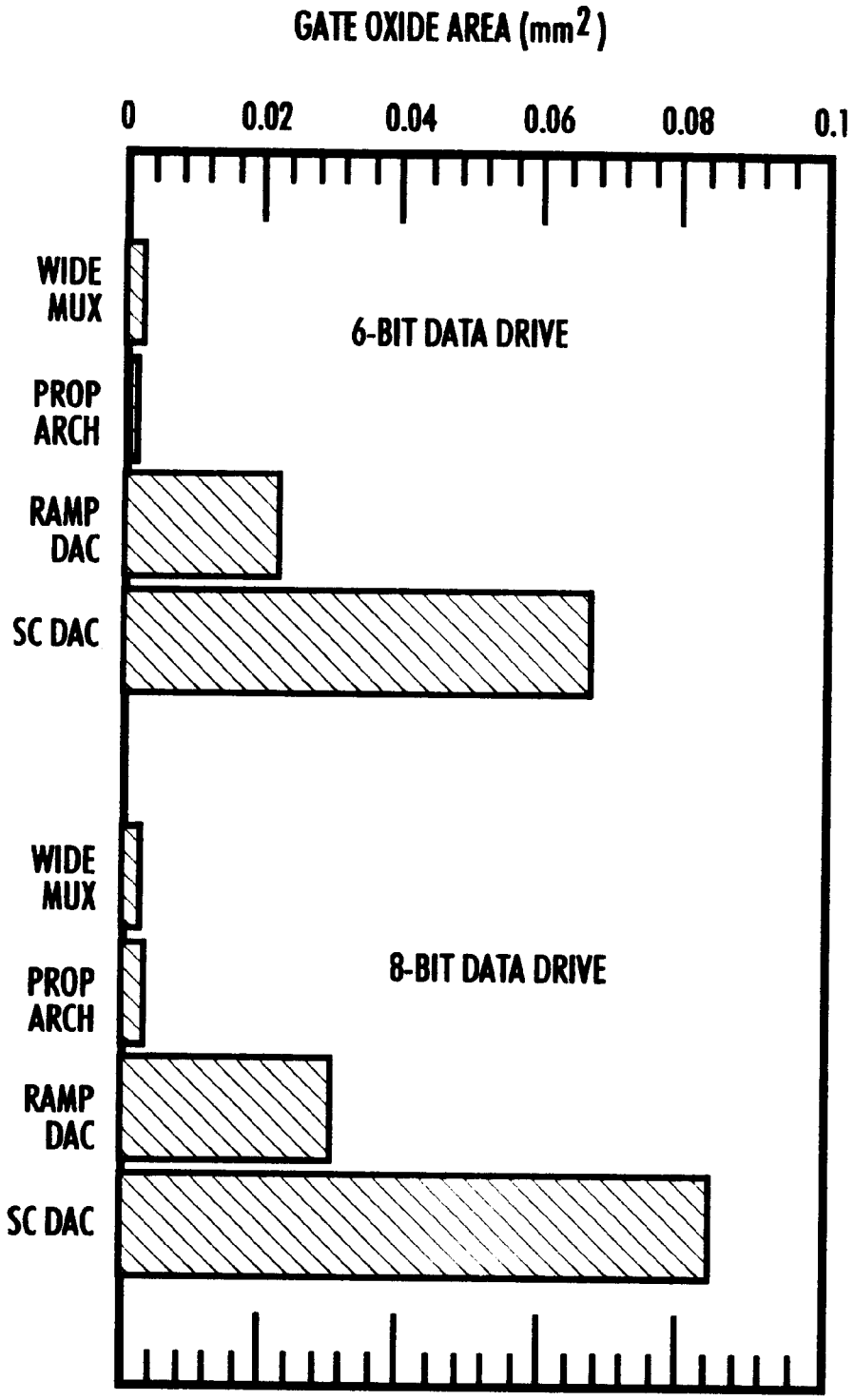
FIG. 11 is a bar graph comparing gate oxide area for the implementation of FIGS. 3–6 with several other architectures.

FIG. 11 therefore compares the total gate oxide areas required for the different architectures. In FIG. 11, the greater digital content of the Ramp DAC architecture is advantageous over SC DAC. The MUX architecture, however, remains more attractive.

Figure 12:
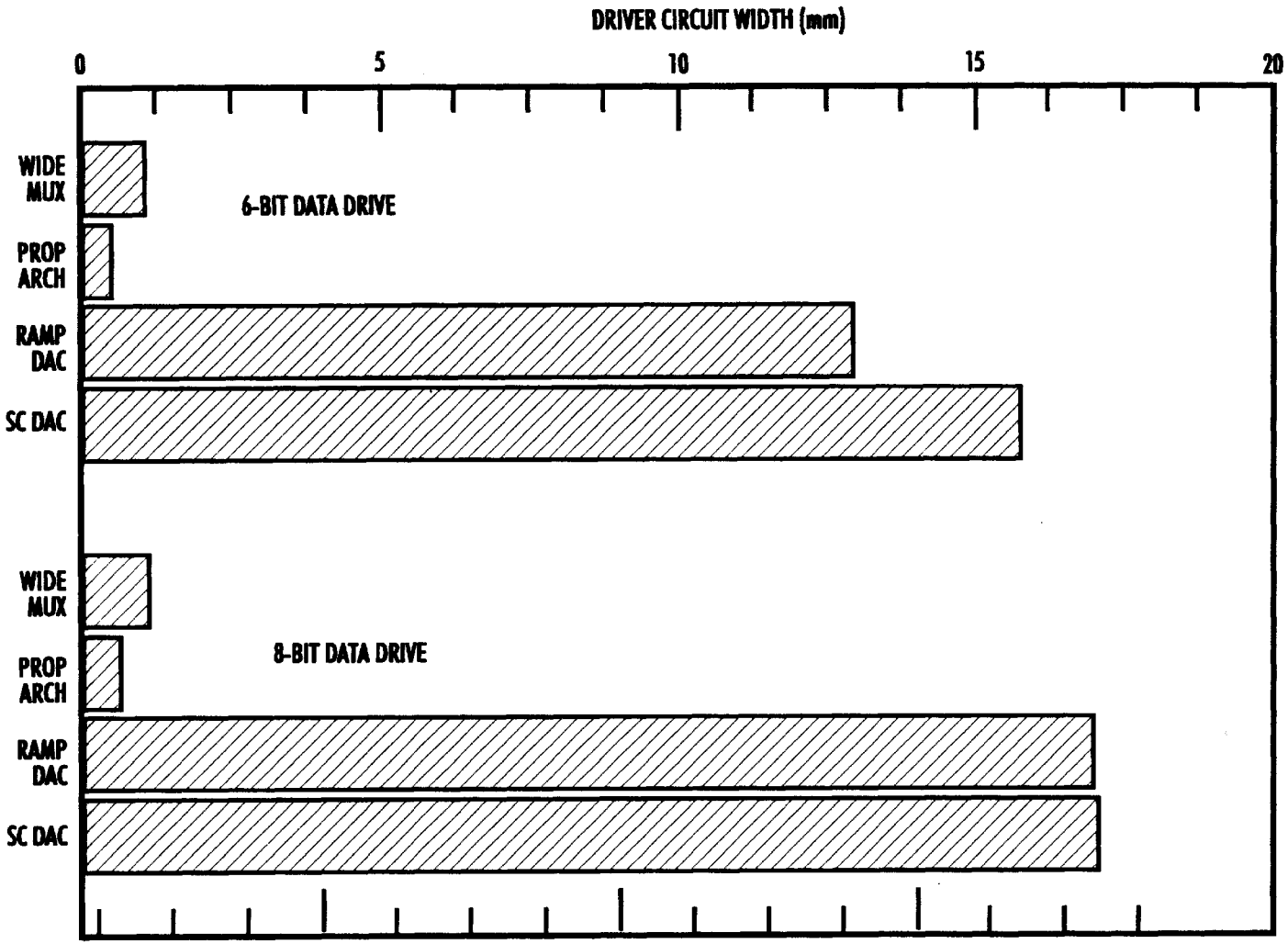
FIG. 12 is a bar graph comparing driver circuit width for the implementation of FIGS. 3–6 with several other architectures.

FIG. 12 extends the comparison by considering the total width of the circuits based on trial layouts and assuming a pixel pitch of 50 $\mu$m. The smallest width is achieved with the narrow MUX of Prop arch because the pass gates are smaller than those required with the wide MUX and there is no data scan shift register.

Figure 13:
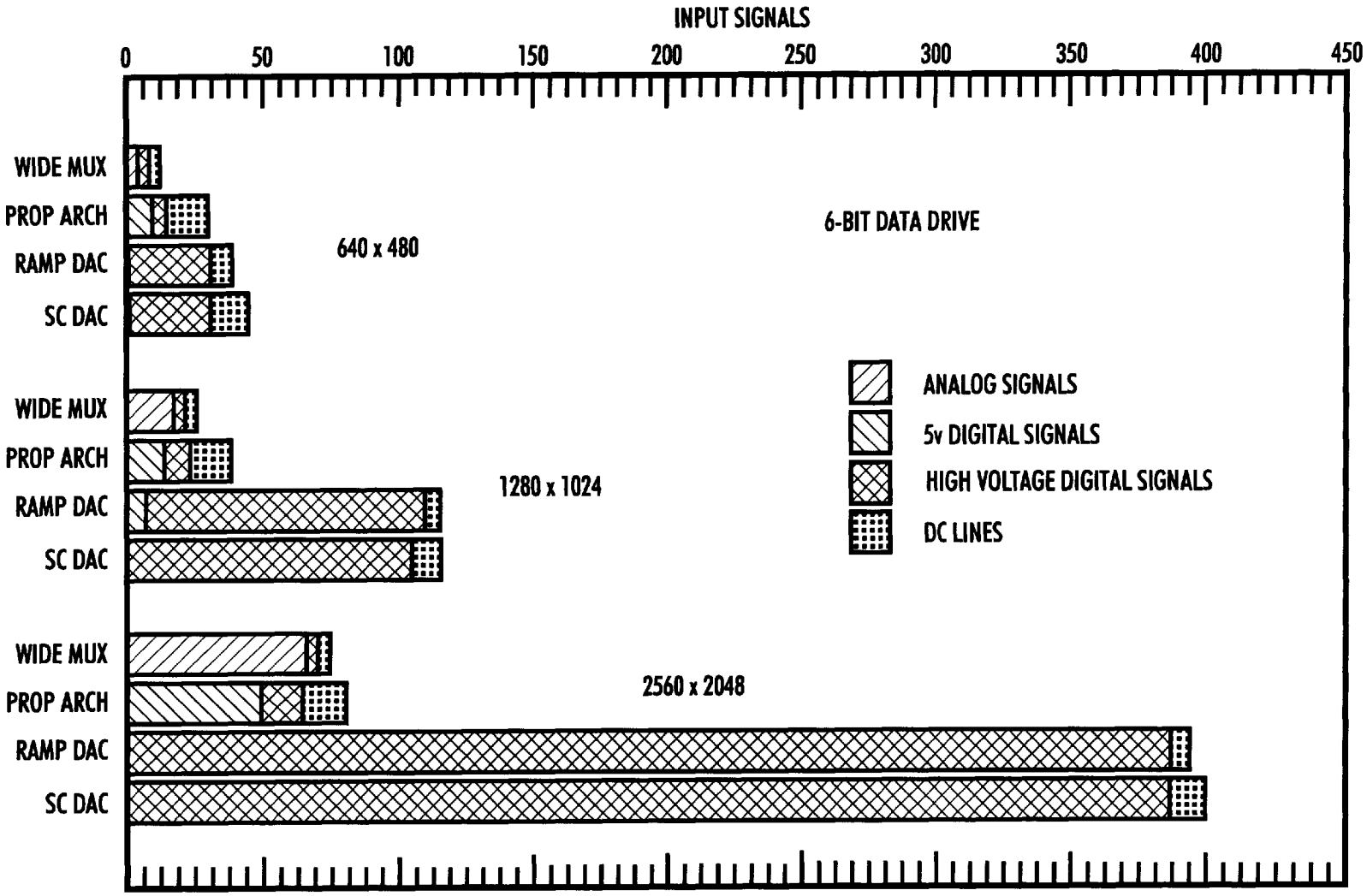
FIG. 13 is a bar graph comparing input signal lines for the implementation of FIGS. 3–6 with several other architectures.

FIG. 13 compares another aspect of the architectures, the input bus width. This aspect is increasingly significant as display pixel count increases. Estimates are shown for monochrome displays with 640×480, 1280×1024, and 2560×2408 pixels. The 2560×2408 pixel size could also be implemented as a full color quad green display, with 1280×1024 color pixels.

As shown in FIG. 13, the wide MUX architecture has the fewest input lines, although most lines are analog, each requiring a DAC circuit to drive it. As the display increases in pixel count, the speed limitation of the integrated TFT pass gates means more analog lines are required, reducing the bus width advantage of the wide MUX. The narrow MUX of Prop arch requires a comparable number of lines as Ramp DAC and SC DAC at low pixel counts, but scales much better to larger pixel counts. The number of 5V digital input lines increases somewhat, but can be kept reasonable low due to the high digital speed available with the single crystal DAC IC. Both Ramp DAC and SC DAC require wide, high voltage digital input buses due to lower clock rates for polysilicon input registers.

Figure 14:
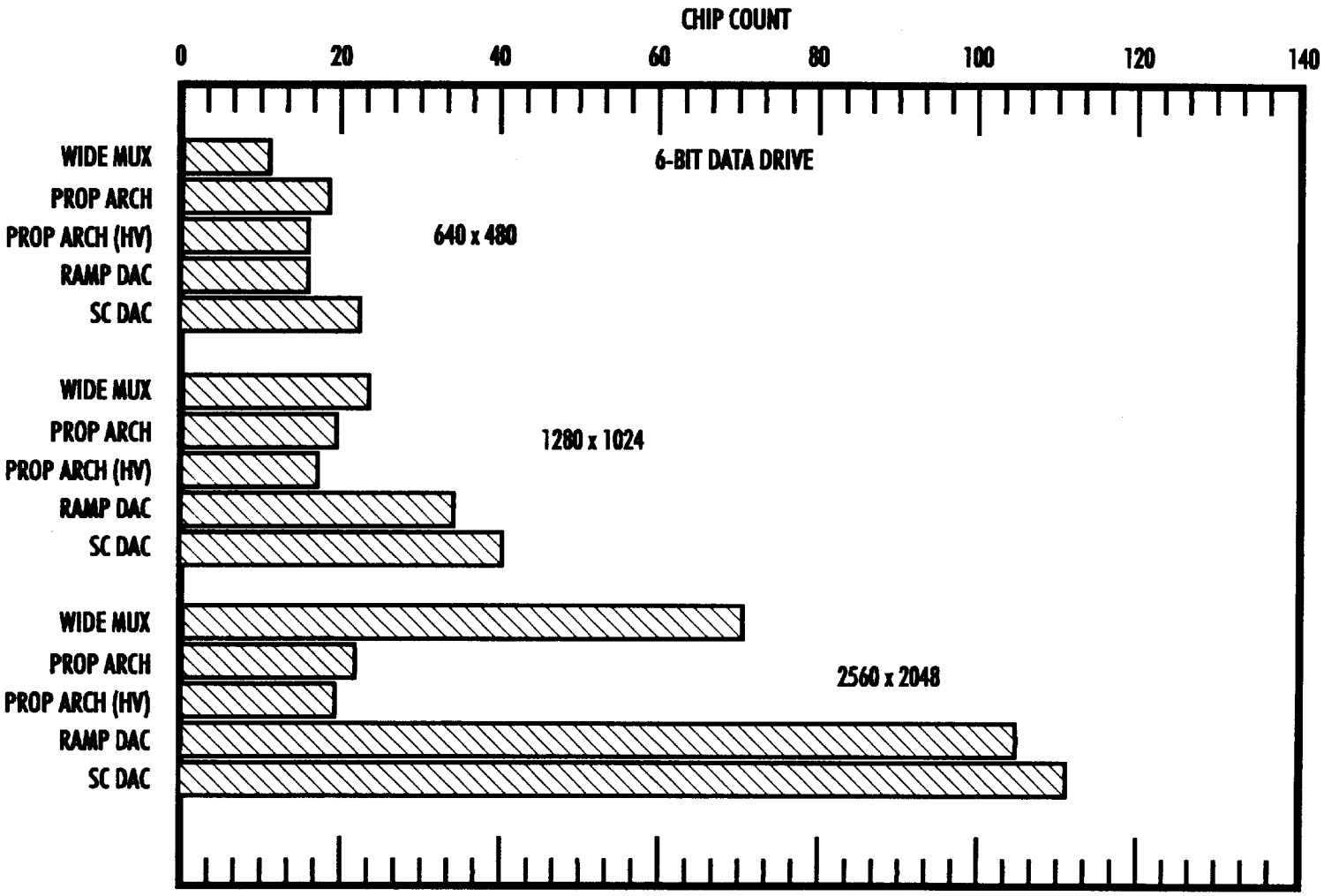
FIG. 14 is a bar graph comparing off-glass chip count for the implementation of FIGS. 3–6 with several other architectures.

Finally, FIG. 14 compares off-glass chip count. At the low pixel count, the architectures are about the same in this comparison. As pixel count increases, the narrow MUX of Prop arch emerges as the best choice. The version labeled "Prop arch" assumes a DAC IC with 5V output voltage swing, while the version labeled "Prop Arch (HV) assumes a DAC IC with 10V output voltage swing. Either type of DAC IC is commercially available in suitable packages.

D.5. Variations

The implementations described above provide thin film circuitry on an insulating substrate. The invention could be implemented with other types of circuitry on other types of substrates.

The implementations described above include array circuitry and multiplexer circuitry having polysilicon TFTs, but the array circuitry and multiplexer circuitry could include other types of switching elements with channels formed of other materials.

The implementations described above include glass substrates, but other substrates could be used, such as quartz.

The implementations described above use commercially available DAC ICs, but the invention could also be implemented with custom DAC ICs. Furthermore, each DAC IC could have any appropriate design. For example, each DAC IC could include, for each analog output, a DAC circuit that performs D/A conversion for that output, or each DAC IC could include only one DAC circuit together with multiplexers and demultiplexers so that the DAC circuit performs D/A conversion for all the analog outputs.

The implementations described above use a single DAC IC, but the invention could be implemented with two or more DAC ICs, which might be necessary for larger arrays, for example.

The implementations described above use TAB and COG techniques to attach an integrated circuit structure to a substrate. The invention could be implemented with other attachment techniques.

The implementations described above employ simple multiplexer circuitry, as shown in FIG. 2. The invention could be implemented with any other appropriate multiplexer circuitry.

The implementations described above employ array circuitry with certain features, but the invention could be implemented with any other appropriate array circuitry. For example, the simulation described above used a 512 by 512 pixel array, but other array sizes could be used.

A 1280×1024 monochrome display with 160 analog drive signals and 8 scan control signals has been designed using the techniques described above in relation to FIGS. 3–6, and is currently in fabrication. At this pixel count, a single DAC IC is adequate to achieve a 72 Hz frame rate, and the structure could be as shown in FIG. 3.

A 2560×2048 display has also been designed. At this pixel count, two or four DAC ICs are required to achieve an acceptable frame rate due to limited input bandwidth. Because of the larger size of the display, however, the substrate has sufficient room to accommodate the additional TAB connections required using conventional bonding techniques and pad pitches.

D. Applications

The invention could be applied in many ways, including arrays for a wide variety of displays and light valves.

E. Miscellaneous

Although the invention has been described in relation to various implementations, together with modifications, variations, and extensions thereof, other implementations, modifications, variations, and extensions are within the scope of the invention. The invention is therefore not limited by the description contained herein or by the drawings, but only by the claims.

What is claimed:

1. A product comprising:

a first substrate with a surface at which circuitry can be formed; and array circuitry formed at the surface of the first substrate, the array circuitry comprising:

a set of N data lines, where N is an integer greater than 32; each of the N data lines extending across the surface of the first substrate; each of the N data lines having a drive input lead in a multiplexer region of the surface of the first substrate; and for each of the N data lines, M units of cell circuitry, each connected for receiving signals from the data line, where M is an integer greater than zero;

multiplexer circuitry formed in the multiplexer region of the surface of the first substrate; the multiplexer circuitry being connected to the drive input lead of each of the N data lines; the multiplexer circuitry comprising:

for each of the N data lines, a drive output lead connected for providing multiplexed signals to the data line's drive input lead;

P analog input leads for receiving input analog drive signals, where P is an integer less than N but not less than 32; and Q multiplexer control leads for receiving multiplexer control signals, where Q is an integer not less than N/P and less than N;

the multiplexer circuitry responding to the input analog drive signals and the multiplexer control signals by providing the multiplexed signals; and one or more integrated circuit structures attached to the first substrate; the integrated circuit structures together comprising:

R single crystal substrates, where R is an integer greater than zero; each single crystal substrate having a surface at which circuitry can be formed; and at the surface of each of the R single crystal substrates, digital-to-analog circuitry; the digital-to-analog circuitry on each substrate's surface having digital input leads and at least S analog output leads, where S is an integer not less than 32; the digital-to-analog circuitry providing, on each analog output lead, an analog drive signal with an amplitude that varies with a value indicated by a digital drive signal received from the digital input leads; the R single crystal substrates together having T analog output leads, where T is an integer not less than P; each of the P analog input leads of the multiplexer circuitry being paired with and connected to one of the T analog output leads so that the R single crystal substrates together provide the input analog drive signals.

2. The product of claim 1 in which each integrated circuit structure is attached to the first substrate so that each of the R single crystal substrates is near the multiplexer circuitry.

3. The product of claim 2 in which each integrated circuit structure further comprises:

a tape attached to the first substrate; the tape including lines for connecting to a subset of the P analog input leads;

one of the R single crystal substrates mounted on the tape.

4. The product of claim 3, further comprising:

a printed circuit board with a surface at which circuitry can be formed;

signal input circuitry formed at the surface of the printed circuit board; the signal input circuitry including digital drive signal leads for providing digital drive signals; the tape further being connected to the signal input circuitry so that lines of the tape provide the digital drive signals to the digital input leads of the R single crystal substrate.

5. The product of claim 2 in which the multiplexer circuitry further comprises:

P pads on the first substrate; the P pads being connected to the P analog input leads;

each of the R single crystal substrates being mounted on a subset of the P pads; the R single crystal substrates together providing input analog drive signals to the P analog input leads through the P pads.

6. The product of claim 1 in which the array circuitry further comprises:

a set of M scan lines; each of the scan lines extending approximately in a first direction across the surface of the first substrate;

each of the N data lines extending approximately in a second direction across the surface of the first substrate; the second direction being different than the first direction so that each of the N data lines crosses each of the M scan lines in a crossing region;

the M units of cell circuitry for each of the N data lines being positioned such that, for each combination of an mth one of the M scan lines and an nth one of the N data lines, an (m×n)th unit of cell circuitry is near the crossing region where the nth data line crosses the mth scan line; the (m×n)th unit of cell circuitry being connected for receiving signals from the mth scan line and the nth data line; the cell circuitry controlling light transmission or reflection in response to the signals from the mth scan line and the nth data line.

7. The product of claim 1 in which the multiplexer circuitry comprises thin film transistors.

8. The product of claim 7 in which the thin film transistors comprise polysilicon channels.

9. The product of claim 8 in which each of the M units of cell circuitry comprises a thin film transistor; the thin film transistor comprising a polysilicon channel.

10. A product comprising:

a first substrate with a surface at which circuitry can be formed; and array circuitry formed at the surface of the first substrate, the array circuitry comprising:

a set of N data lines, where N is an integer greater than 32; each of the N data lines extending across the surface of the first substrate; each of the N data lines having a drive input lead in a multiplexer region of the surface of the first substrate; and for each of the N data lines, M units of cell circuitry, each connected for receiving signals from the data line, where M is an integer greater than zero;

multiplexer circuitry formed in the multiplexer region of the surface of the first substrate; the multiplexer circuitry being connected to the drive input lead of each of the N data lines; the multiplexer circuitry comprising:

for each of the N data lines, a drive output lead connected for providing multiplexed signals to the data line's drive input lead;

P analog input leads for receiving input analog drive signals, where P is an integer less than N but not less than 32; and Q multiplexer control leads for receiving multiplexer control signals, where Q is an integer not less than N/P and less than N;

the multiplexer circuitry responding to the input analog drive signals and the multiplexer control signals by providing the multiplexed signals;

a second substrate with a surface at which circuitry can be formed; signal input circuitry formed at the surface of the second substrate; the signal input circuitry including digital drive signal leads for providing digital drive signals;

R integrated circuit structures attached to the first substrate and to the second substrate, where R is an integer greater than zero; each integrated circuit structure comprising:

a tape connected to the signal input circuitry on the second substrate and to the multiplexer circuitry on the first substrate; the tape including input lines for connecting to the digital drive signal leads and output lines for connecting to a subset of the P analog input leads;

a single crystal substrate mounted on the tape; the single crystal substrate having a surface at which circuitry can be formed; and at the surface of the single crystal substrate, digital-to-analog circuitry; the digital-to-analog circuitry having digital input leads and at least S analog output leads, where S is an integer not less than 32; the digital-to-analog circuitry providing, on each analog output lead, an analog drive signal with an amplitude that varies with a value indicated by a digital drive signal received from the digital input leads;

the R integrated circuit structures together having T analog output leads, where T is an integer not less than P; each of the digital drive signal leads of the signal input circuitry being paired with and connected to one of the digital input leads through an input line and each of the P analog input leads of the multiplexer circuitry being paired with and connected to one of the T analog output leads through an output line so that the single crystal substrates of the R integrated circuit structures together receive the digital drive signals and provide the input analog drive signals.

11. The product of claim 10 in which the second substrate is a printed circuit board.

12. A display comprising:

a first substrate with a surface at which circuitry can be formed; and array circuitry formed at the surface of the first substrate, the array circuitry comprising:

a set of M scan lines, where M is an integer greater than one; each of the scan lines extending approximately in a first direction across the surface of the substrate;

a set of N data lines, where N is an integer greater than 32; each of the N data lines extending approximately in a second direction across the surface of the first substrate; the second direction being different than the first direction so that each of the N data lines crosses each of the M scan lines in a crossing region; each of the N data lines having a drive input lead in a multiplexer region of the surface of the first substrate; and for each combination of an mth one of the M scan lines and an nth one of the N data lines, (m×n)th cell circuitry near the crossing region where the nth data line crosses the mth scan line; the (m×n)th cell circuitry being connected for receiving signals from the mth scan line and the nth data line; the mth and (m+1)th ones of the scan lines and the nth and (n+1)th ones of the data lines bounding a cell area; the (m×n)th cell circuitry comprising a cell electrode in the cell area; the cell electrode being connected to the nth data line; the cell electrode being light transmissive;

multiplexer circuitry formed in the multiplexer region of the surface of the first substrate; the multiplexer circuitry being connected to the drive input lead of each of the N data lines; the multiplexer circuitry comprising:

for each of the N data lines, a drive output lead connected for providing multiplexed signals to the data line's drive input lead;

P analog input leads for receiving input analog drive signals, where P is an integer less than N but not less than 32; and Q multiplexer control leads for receiving multiplexer control signals, where Q is an integer not less than N/P and less than N;

the multiplexer circuitry responding to the input analog drive signals and the multiplexer control signals by providing the multiplexed signals;

R integrated circuit structures attached to the first substrate, where R is an integer greater than zero; each integrated circuit structure comprising:

a tape connected to the multiplexer circuitry on the first substrate; the tape including output lines for connecting to a subset of the P analog input leads;

a single crystal substrate mounted on the tape; the single crystal substrate having a surface at which circuitry can be formed; and at the surface of the single crystal substrate, digital-to-analog circuitry; the digital-to-analog circuitry having digital input leads and at least S analog output leads, where S is an integer not less than 32; the digital-to-analog circuitry providing, on each analog output lead, an analog drive signal with an amplitude that varies with a value indicated by a digital drive signal received from the digital input leads;

the R integrated circuit structures together having T analog output leads, where T is an integer not less than P; each of the P analog input leads of the multiplexer circuitry being paired with and connected to one of the T analog output leads through an output line so that the single crystal substrates of the R integrated circuit structures together provide the input analog drive signals; and a liquid crystal material positioned along the cell electrode so that signals on the mth scan line and the nth data line control transmissivity of the liquid crystal material.

* * * * *